United States Patent [19]

Brown, Jr.

[11] Patent Number: 4,888,894

[45] Date of Patent: Dec. 26, 1989

[54] STAND FOR SAFETY SIGN OR THE LIKE

[76] Inventor: Herman O. Brown, Jr., 110 Cedar Ct., Marietta, Ga. 30067

[21] Appl. No.: 244,083

[22] Filed: Sep. 14, 1988

[51] Int. Cl.[4] ..... G09F 15/00

[52] U.S. Cl. ..... 40/606; 40/602; 40/603; 40/607; 40/612; 248/624

[58] Field of Search ..... 40/607, 606, 610, 612, 40/602, 603, 611; 248/624, 160, 170; 116/63 C, 638

[56] References Cited

U.S. PATENT DOCUMENTS

| | | | |
|---|---|---|---|
| 3,950,873 | 4/1976 | Stehle et al. | 40/612 |
| 4,197,808 | 4/1980 | Kinninger | 40/612 |
| 4,309,836 | 1/1982 | Knapp | 40/602 |
| 4,426,800 | 1/1984 | Brown | 40/603 |
| 4,507,887 | 4/1985 | Seely | 40/606 |
| 4,509,714 | 4/1985 | Seely | 40/602 |
| 4,691,892 | 9/1987 | Grewe et al. | 40/602 |
| 4,790,092 | 12/1988 | Farmer | 40/611 |

*Primary Examiner*—Kenneth J. Dorner
*Assistant Examiner*—J. Hakomaki
*Attorney, Agent, or Firm*—Jones, Askew & Lunsford

[57] ABSTRACT

A sign stand for supporting highway safety signs or the like. The stand includes a plurality of folding legs which support the stand on the ground. The legs support a socket having an open upper end to receive the mounting bracket formed at one corner of a side. A latch mechanism includes a hook normally extending within the socket, and cammed to one side as the mounting bracket enters the socket. The lever extends laterally from a side of the socket, enabling withdrawal of the hook to remove the sign.

6 Claims, 2 Drawing Sheets

STAND FOR SAFETY SIGN OR THE LIKE

FIELD OF INVENTION

This invention relates in general to sign stands or the like, and in particular relates to sign stands used for supporting portable highway safety signs or the like.

BACKGROUND OF THE INVENTION

Traffic and highway safety signs are in widespread use to advise motorists and others of temporary or emergency conditions along roadways. These safety signs usually are intended for relatively temporary use at particular locations where repair or rebuilding of the roadway is taking place, or where other nonpermanent traffic safety conditions arise. To that end, such signs preferably are portable instead of being permanently installed in the ground, so that highway maintenance personnel can easily relocate the signs as repaving or repair progresses along the highway, or as temporary traffic conditions otherwise change.

Highway safety signs intended for temporary use usually comprise a sign panel bearing an appropriate warning or safety message, and a separate stand for supporting and displaying message panel. The support stands usually are designed and constructed so that one person can readily move the stand from a truck to a particular site, and the stands often are partially collapsible or foldable for occupying less space when stored. Some stands have a number of individual ground-engaging legs which support the stand when in use, and which are foldable to reduce the overall area occupied by the stand when not in use. Examples of traffic safety sign stands and related signs are shown in U.S. Pat. Nos. 3,591,116 and 4,498,657.

Safety sign stands intended for highway use must be relatively sturdy to withstand the environment of use. The stand also should quickly and easily accept a particular sign, and should be capable of locking the sign to the stand without requiring manipulation of screws or other controls to secure the sign to the stand. Securing the sign to the stand reduces the likelihood that a sign will become detached and lost, or will present a traffic hazard if the stand becomes overturned by strong winds or by a vehicle striking the stand. However, the stand also should permit easy unlocking and removal of a previously-attached sign, preferably without bending over to release or unlatch the locking mechanism in the stand, so that a person can remain upright while unlocking the sign and lifting it from the stand. Further yet, a sign stand should accept and support, without special adapters or mounting masts, flexible signs having rigid corner brackets; such flexible signs are disclosed in U.S. Pat. No. 4,426,800.

SUMMARY OF INVENTION

Accordingly, it is an object of the present invention to provide an improved stand for safety signs or the like.

It is another object of the present invention to provide a sign stand which readily engages and releases safety signs or the like.

It is a further object of the present invention to provide a stand which accommodates signs having rigid mounting brackets adjacent an edge of the sign message panel.

Stated in general terms, the present stand includes a receptacle extending upwardly from a base having a number of legs operative to engage the ground. The legs preferably are adjustable to accommodate irregular or uneven surfaces, and are foldable relative to the base to permit storing the stand in a relatively compact configuration. The receptacle receives the mounting bracket or similar structure of a safety sign, and retains the mounting bracket in place so that the sign is securely held by the stand. The receptacle preferably is configured to accommodate the edge of a sign panel adjacent the mounting bracket for supporting the panel by the stand.

Stated somewhat more particularly, the mounting bracket is engaged and retained within the receptacle by a latch member normally disposed within the receptacle. The latch member is operative for temporary displacement from the receptacle as the sign mounting bracket enters; the latch member then engages the mounting bracket to hold the bracket and an attached sign panel in a predetermined display portion relative to the stand. A latch release member extends outwardly from the receptacle and is manually operable to withdraw the latch member from the socket, thereby permitting withdrawal of the mounting bracket. This latch release member preferably is positioned for ready manipulation by the hand or foot of an operator, permitting easy withdrawal of the mounting bracket.

Stated in somewhat greater detail, the latch member comprises a hook on an elongated plate disposed along the exterior of the receptacle. The hook selectively extends through a lateral opening into the receptacle, and the elongated plate extends downwardly from the hook to a pivotable connection allowing sufficient movement of the plate so that the hook moves through the lateral opening and into or our of the receptacle. A latch release member extends outwardly from the elongated plate at a point below the pivot connection. Vertical movement of the elongated plate withdraws the hook from the lateral opening in the receptacle, and thus from engagement with a mounting bracket within the receptacle.

The nature of the present invention, as well as other objects and advantages thereof, will become more readily apparent from the following detailed description.

DETAILED DESCRIPTION OF PREFERRED EMBODIMENT

Figure 1:
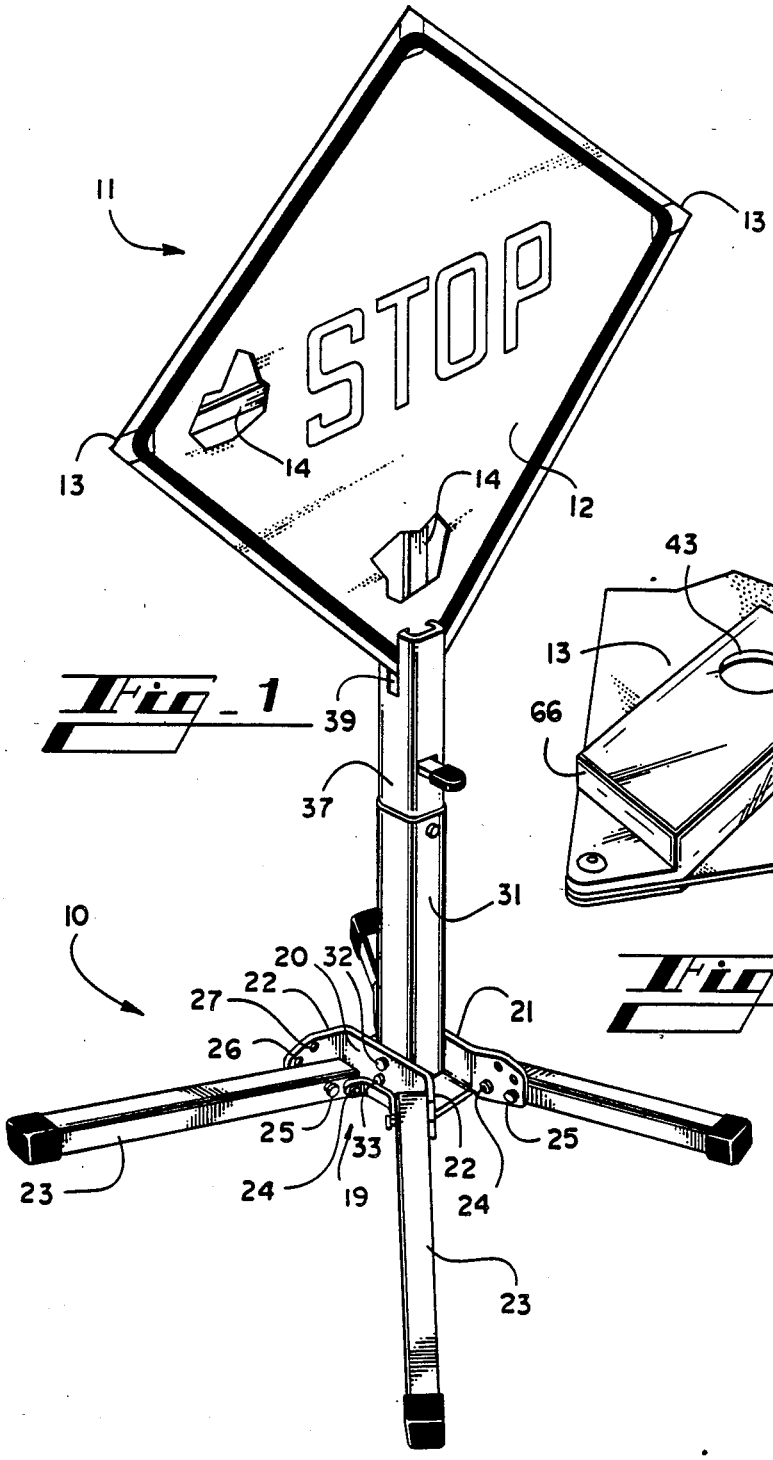
FIG. 1 is a pictorial view, partially broken away for illustrative purposes, showing a sign stand according to a preferred embodiment of the present invention.

Turning first to FIG. 1, there is shown generally at 10 stand constructed according to the present invention and supporting a highway safety sign 11. The sign 11 is generally of the kind disclosed in the previously-mentioned U.S. Pat. No. 4,426,800, and has a flexible message panel 12 in the shape of a diamond commonly associated with highway warning messages. Separate mounting brackets 13 are affixed at each corner of the panel 12, and a pair of frame members 14 extend between mounting brackets at opposite corners of the panel to maintain the sign 11 in the extended configuration shown in FIG. 1.

Figure 2:
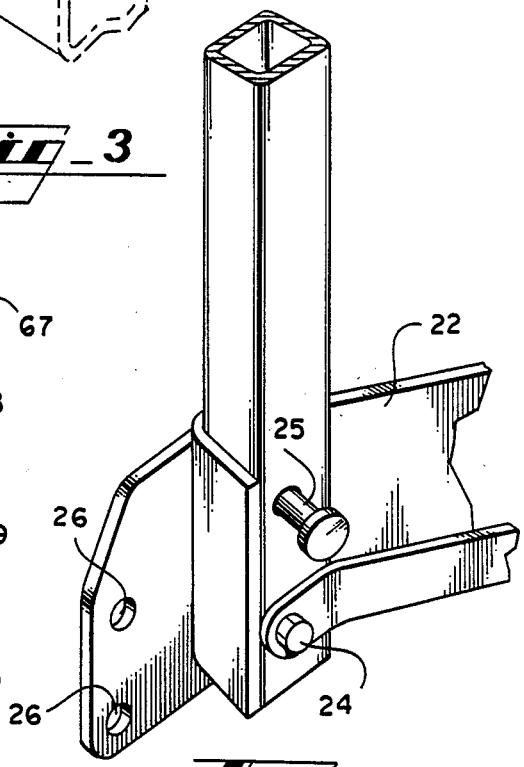
FIG. 2 is a fragmentary pictorial view showing a leg of the present stand in the folded position.

A typical one of the mounting brackets 13 is shown in greater detail in FIG. 2. Each mounting bracket defines an open socket 16 for receiving an end of a frame member 14. The frame members 14 are pivotably interconnected at their midpoints (not shown) to provide structural rigidity to the sign when erected, and to assist in folding the frame members when removed from the sign mounting brackets 13. Further structural and functional details of the mounting brackets 13 are discussed below.

The sign stand 10 includes a somewhat U-shaped base 19 having sides 20 and 21 defining the vertical portions of the U. A pair of ears 22 extend diagonally outwardly from the opposite ends of each side 20 and 21, and to each ear is pivotably attached one of the four legs 23 which support the stand on the ground. The legs 23 can include a telescopically-extensible inner section (not shown) to increase the effective ground support area for the stand. A hinge pin or bolt 24 pivotably attaches each leg 23 to a corresponding ear 22, and a spring-loaded detent pin 25 extends through the leg a short distance outwardly from the hinge pin. The detent pin 25 for each leg 23 is spring-biased to selectively engage either of the two holes 26 formed adjacent the lower portion of the corresponding ear 22 to which that leg is attached, so as to lock the leg in either of two extended positions. The provision of two such holes 26 allows adjusting the angular position of each leg 23 to accommodate uneven terrain where the stand 10 is positioned. A third hole 27 is formed in each ear 22 for engaging the detent pin 25 when the leg 23 is pivoted to a near-vertical position. The holes 27 thus permit locking the legs 23 in the near-vertical position shown in FIG. 2, for ease of carrying and stowing the stand 10.

Figure 4:
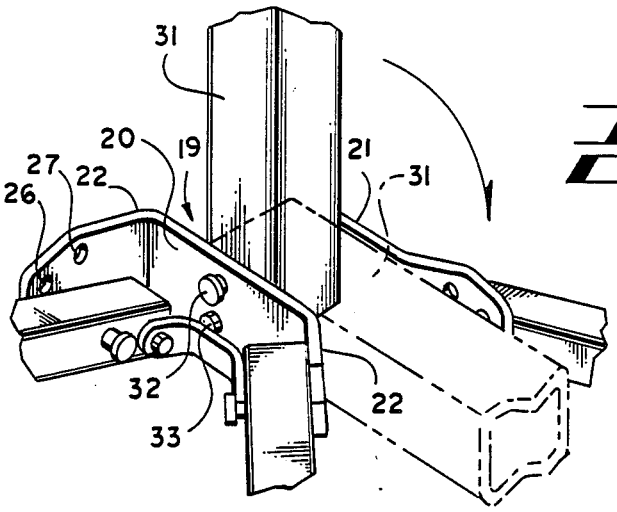
FIG. 4 is a fragmentary pictorial view of the present stand, with the laid-over position of the sign support shown therein in phantom.

A support housing 31 is mounted within the open channel defined by the two sides 20, 21 of the base 19. The support housing 31 has the shape of an elongated hollow tube rectangular in cross-section. The support housing 31 preferably is pivotably mounted between the sides 20 and 21 by means of a hinge pin 33 extending through aligned openings in the sides, and through confronting holes near the bottom end of the support housing. The supporting housing 31 is normally maintained in its upright position, shown in FIG. 2, by the holding member 32 which extends through at least one of the sides 20, 21 and engages a confronting portion of the supporting housing 31. The holding member 32 can be either a detent for normally locking the support housing 31 in the upright position, or alternatively can be a shear pin extending through the support housing. In any case, the holding member 32 functions to maintain the support housing 31 in the upright position during normal operation of the stand 10. However, the holding member 32 releases the support housing 31 and allows the housing to pivot downwardly around the pivot pin 33 as shown in phantom in FIG. 4, whenever the support housing or a sign carried thereby is struck by an oncoming vehicle.

Figure 3:
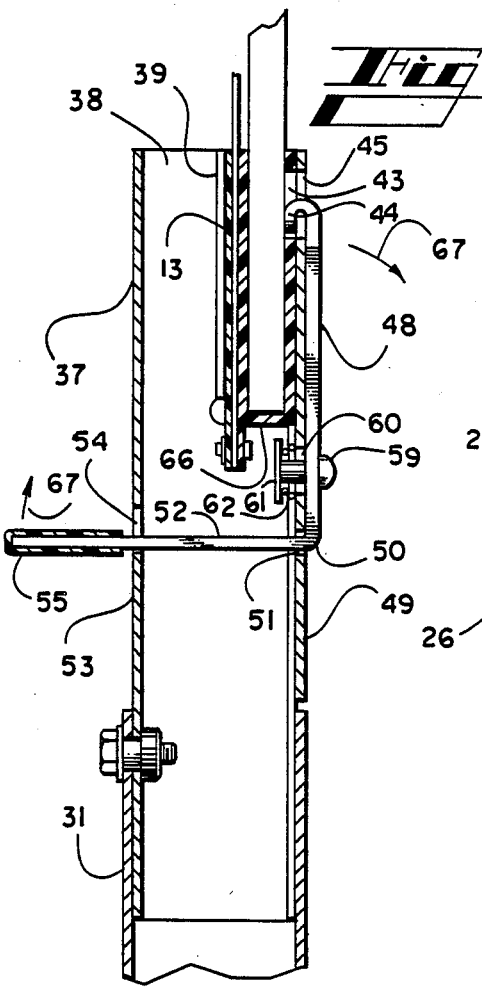
FIG. 3 is a partial section view of the stand shown in FIG. 1.

Mounted within the hollow support housing 31 and extending upwardly therefrom is the sign attaching socket 37. The socket 37 is securely fastened to the support housing 31, so as to bear the weight of the sign 11. The upper end 38 of the socket 37 is open as best seen in FIG. 3, for receiving the mounting bracket 13 disposed at the lowermost corner of the sign 11. The mounting bracket 13 is rectangular in cross-section as best seen in FIG. 2, and the upper end 38 of the socket 37 defines a receptacle configured to loosely slidingly receive the mounting bracket when lowered vertically into the receptacle. Slots 39 are formed in two opposed sides of the socket 37 extending downwardly from the open upper end 38, so as to accommodate the sides of the sign panel 12 immediately adjacent the mounting bracket 13 received in the receptacle. The slots 39 thus allow fastening a sign 11 directly to the stand 10 without requiring an adapter pole or support extending between the socket 38 and the frame members 14 of the sign.

Figure 5:
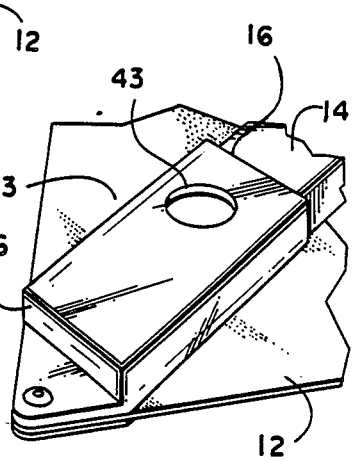
FIG. 5 is a detailed pictorial view of a mounting bracket and fragmentary sign panel supported by the stand shown in FIG. 1.

At least the mounting bracket 13 at the bottom corner of the sign 11 has an opening 43, FIG. 5, formed on one side. This opening 43 aligns with the hook 44, FIG. 3, protruding into the bracket-receiving receptacle through a hole 45 formed in one side of the socket 37. The hook 44, in the shape of an inverted-J, thus receives and positively retains the mounting bracket 13 within the upper end 38 of the socket 37, preventing untimely removal of the sign 11 from the stand 10.

The hook 44 is formed at one end of an elongated plate 48 resting against the outer surface of one side 49 on the socket 37. The plate 48 extends downwardly along the side 49 to a right-angle bend 50, where the plate turns inwardly to extend through the slot 51 in that side of the socket. The laterally-extending portion 52 of the plate 48 extends through the hollow interior of the socket 37, emerging through an elongated slot 54 formed in the opposite side 53 of the socket. A cover 55 fits over the terminal end of the portion 52 extending outside the opposite side 53.

The plate 48 is mounted on the socket 37 by the bolt 59 which engages the plate a short distance above the bend 50. The bolt 59 extends inwardly from the plate, passing through a hole 60 in the one side 49 of the socket. The diameter of the hole 60 is enlarged relative to that of the bolt 59, allowing the bolt to undergo a limited extent of rocking or tipping movement within the hole. A nut 61 larger than the hole 60 fastens to the inner end of the bolt 59, thereby retaining the bolt and the plate 48 on the socket 37. A compression spring 62 fits around the bolt between the nut 61 and the adjacent inside surface of the socket side 49, urging the boltinwardly of the hole 60 and causing the attached plate 48 to lie snugly alongside the side 49 of the socket. This spring-biased location of the plate 48 keeps the hook 44 normally disposed within the socket 37, as previously mentioned.

The operation of the stand is now described. Assuming the legs 23 are already extended and the base 19 is positioned to place the support housing 31 in an approximately upright attitude, the sign 11 is now positioned to place the lowermost mounting bracket 13 immediately above the open upper end 38 of the socket. The sign is then lowered, allowing the mounting bracket 13 to enter the socket. The leading edge 66 at the bottom of the mounting bracket 13 at this time contacts the outer curvature of the hook 44, camming the hook outwardly through the hole 45 in the side 49 of the socket as indicated by the directional arrows 67. This outwardly-camming movement takes place against the bias of the spring 62. The mounting bracket 13 slides further into the open upper end 38, the slots 39 accommodating the panel 12 of the sign 11, until the mounting bracket is fully received within the receptacle. At that point the opening 43 on the mounting bracket 13 is aligned with the hook 44, allowing the hook to reenter the receptacle in response to the bias of the spring 62. The hook 44 thus securely engages the mounting bracket 13 through the opening 43 therein, so that the sign 11 at this time cannot be unintentionally removed from the stand 10.

To remove the sign 11 from the stand, the covered outer end 55 of the plate portion 52 is raised a short distance. This movement tilts the plate 48 about a fulcrum point defined by the right-angle bend 50 and the slot 51, thereby withdrawing the hook 44 outwardly of the hole 43 of the mounting bracket 13. The sign 11 is then lifted upwardly, withdrawing the mounting bracket 13 from the socket. The upward movement of the end 55 to unlatch the sign 11 is easily accomplished by placing the toe of one's shoe beneath the lever, inasmuch as the resilient force imparted by the spring 62, and overcome by movement of the lever, need not be particularly strong to normally retain the hook 44 in latching engagement with the sign.

It will now be understood that the present stand provides a positive latch for safety signs, so that the sign remains attached to the stand even where the stand has become overturned through windstorm or other accidents. Moreover, the sign is readily unlatched and removed from the stand with minimal effort when desired, by a person who can remain standing and lift upwardly on the sign without needing to bend over while manipulating and unlatching mechanism.

Although the present sign stand is described for use with a particular kind of safety sign, it should be understood that the stand is readily adopted to support other kinds of signs. For example, by fitting an upright sign post of conventional design with a mounting bracket externally resembling the bracket 13, that sign post is supportable in the stand and can serve as a mounting post for various signs and the like.

It will be understood that the foregoing relates only to a preferred embodiment of the invention, and that numerous changes and modifications may be made therein without departing from the spirit and scope of the invention as defined in the following claims.

What is claimed is:

1. Apparatus for supporting a safety sign or the like having a message panel and a mounting bracket adjacent an edge of the message panel, comprising:

base means;

a plurality of legs associated with the base means and selectively operative to engage the ground while maintaining the base means at a predetermined attitude in relation to the ground;

a socket carried by the base means and operative to receive and retain the mounting bracket of a safety sign, the socket comprising a tubular member open at an end to define a recess for receiving the mounting bracket; and a slot in the tubular member to receive an adjacent edge portion of the message panel as the mounting bracket enters the recess.

so that the socket receives the mounting bracket to support the sign without interfering with the message panel.

2. Apparatus for supporting a safety sign or other article having a mounting bracket adjacent an edge of the sign, and upright means associated with the mounting bracket, comprising:

a base having plural legs operative to engage the ground;

means extending upwardly from the base and defining a hollow socket having an open upper end for receiving the mounting bracket;

a slot formed in the socket-defining means and extending downwardly from the open upper end of the socket to receive edge portions of the sign which otherwise would interfere with the socket when the mounting bracket is received in the socket;

a latch member normally disposed within the socket and operative in response to entry of the mounting bracket to withdraw from the socket and then engage the mounting bracket within the socket, thereby holding the mounting bracket and upright means in a predetermined display position; and a latch release member extending outwardly from the socket and manually operative to withdraw the latch member from the socket, thereby permitting withdrawal of the mounting bracket from the support apparatus.

3. Apparatus as in claim 2, wherein:

the socket has a lateral opening on one side positioned for alignment with a latching detent formed on the mounting bracket, when the mounting bracket is received in the socket;

the latch member comprises a hook on an elongated plate disposed on the exterior of the socket, the hook being aligned with the lateral opening on the socket and being movable therein;

the plate extending downwardly from the hook to a pivotable fulcrum at a location below the lateral opening, allowing the plate to move about the fulcrum sufficiently so that the hook moves through the lateral opening and into or out of the socket; and the latch release member is attached to the plate at a point below the pivotable connection.

4. Apparatus as in claim 2, wherein:

the socket-defining means comprises a tubular member having said open upper end; and the slot is one of a pair of slots formed in two opposed sides of the tubular member, the slots communicating with the open upper end and extending downwardly a distance therefrom sufficient to receive the edge portions of the sign.

5. Apparatus for supporting a safety sign or other article having a mounting bracket and upright means associated with the mounting bracket, comprising:

a base having plural legs operative to engage the ground;

means extending upwardly from the base and defining a hollow socket having an open upper end for receiving the mounting bracket;

a latch member normally disposed within the socket and operative in response to entry of the mounting bracket to withdraw from the socket and then engage the mounting bracket within the socket, thereby holding the mounting bracket and upright means in a predetermined display position;

the socket having a lateral opening on one side positioned for alignment with a latching detent formed on the mounting bracket, when the mounting bracket is received in the socket;

the latch member comprising a hook on an elongated plate disposed on the exterior of the socket, the hook being aligned with the lateral opening on the socket and being movable therein;

the plate extending downwardly from the hook to a pivotable fulcrum at a location below the lateral opening, allowing the plate to move sufficiently so that the hook moves through the lateral opening and into or out of the socket; and a latch release member attached to the plate at a point below the pivotable connection and extending outwardly from the socket, the release member being manually operative to withdraw the latch member from the socket, and thereby permitting withdrawal of the mounting bracket from the support apparatus.

6. Apparatus as in claim 5, further comprising:

a first opening in the side of the socket below the pivotable connection;

a second opening in the side of the socket opposite the first such opening;

the latch release member comprising an operating member extending through the first and second openings to a terminal end located a distance outwardly from the second opening in the side of the socket; and the terminal end being selectively raisable to pivot the bar about the lower end, thereby withdrawing the hook from the lateral opening and from the aligned latching detent of a mounting bracket within the socket.

* * * * *